US006089954A

United States Patent [19]

Grewe

[11] Patent Number: 6,089,954

[45] Date of Patent: Jul. 18, 2000

[54] BRASSIERE WITH BREAST SEPARATION CONSTRUCTION

[76] Inventor: Lynne Louise Grewe, 730 Orchid Ave., Capitola, Calif. 95010

[21] Appl. No.: 09/132,865

[22] Filed: Aug. 11, 1998

[51] Int. Cl.[7] ..... A41C 3/00

[52] U.S. Cl. ..... 450/1; 450/8

[58] Field of Search ..... 450/1, 15, 16, 450/30, 31, 32, 58, 79, 80, 8, 9, 10, 11, 12, 13, 14, 17, 18, 19, 20, 21, 22, 23, 24, 25, 26, 27, 28, 29, 60, 69, 61, 68, 59, 70, 73, 74, 75; 2/73

[56] References Cited

U.S. PATENT DOCUMENTS 4,416,284 11/1983 Fink .

5,603,653 2/1997 Hartman .

5,664,984 9/1997 Laughridge .

5,697,830 12/1997 White ..... 450/36

*Primary Examiner*—Gloria Hale

[57] ABSTRACT

A brassiere or body garment with breast separation feature comprises a pair of cup and front-wrap regions. The independent front-wrap sections and cup components are connect approximately near the side or back regions of the brassiere. The independence results in breast separation resulting in reduced perspiration, and additionally provides improved breast support, and increased comfort and freedom of movement.

2 Claims, 6 Drawing Sheets

BRASSIERE WITH BREAST SEPARATION CONSTRUCTION

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates in general to brassiere and torso body garments. More particularly, it relates to an improved brassiere for separation of the pair of breasts, while at the same time maintaining and improving the desired support and appearance of the breasts and improving comfort.

2. The Prior Art

In the past, women have suffered with poor structural design of brassieres that constrict and push together the pair of breasts at the breast bone. This is particularly exaggerated in larger-breasted women and can cause problems with appearance, excess perspiration, and discomfort. To solve these problems, the present invention provides a brassiere of independent front sections spanning the front chest area that produce a separation of breasts leading to reduction in perspiration and improved appearance and comfort. Related prior art has not addressed the issue of breast separation and related benefits.

U.S. Pat. No. 5,603,653 addresses the issue of upper-body perspiration through the creation of absorbent pads. These pads to not comprise a body garment nor a brassiere.

U.S. Pat. No. 5,664,984 addresses the issue of frontal moisture control through the construction of a brassiere with a moisture absorbent material attached to the area between breast cups.

U.S. Pat. No. 4,416,284 is constructed of different cups that can be independently sized for a woman with different sized breasts. Each cup and its attached material are entirely independent of each other and are affixed to the body using totally independent straps and are nowhere connected.

U.S. Pat. No. 4,127,135 is a brassiere claiming to achieve a greater independence of movement of the different breasts and has a small crossing between the cups at the breast bone area of the chest.

BRIEF SUMMARY OF THE INVENTION

It is an object of this invention to provide a new and novel brassiere.

It is an object of this invention to provide the wearer of the brassiere separation of the breasts. Another object of this invention is to provide improved appearance, comfort and support and reduce perspiration for the wearer of the said brassiere.

It is an object of this invention to provide the wearer with an increased freedom of movement and placement of the breasts in the brassier.

Other objects, features and advantages of this invention in its details of construction and arrangement of parts will be seen from the above, from the detailed description of the invention when considered with the drawings and from the appended claims.

DETAILED DESCRIPTION OF THE INVENTION

Figure 1:
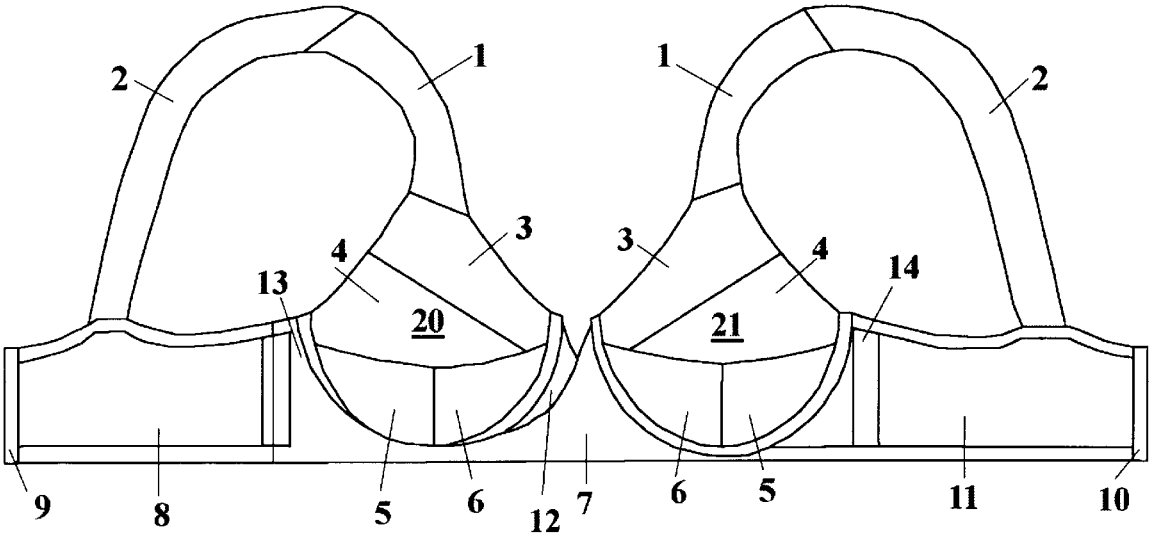
FIG. 1 is a front view of the brassier shown in an open, non-use condition.

Referring to the drawings in particular, the invention embodied in FIG. 1. comprises a brassiere (possibly as an integral part of a body garment or foundation garment) which has breast receiving cups 20 and 21 which are continued in front by their individual wrap sections 7 and 12. A cup and its wrap section, for example 20 and 12, are not attached along the front chest by any means to the other cup and its wrap section, in our example 21 and 7.

Figure 3:
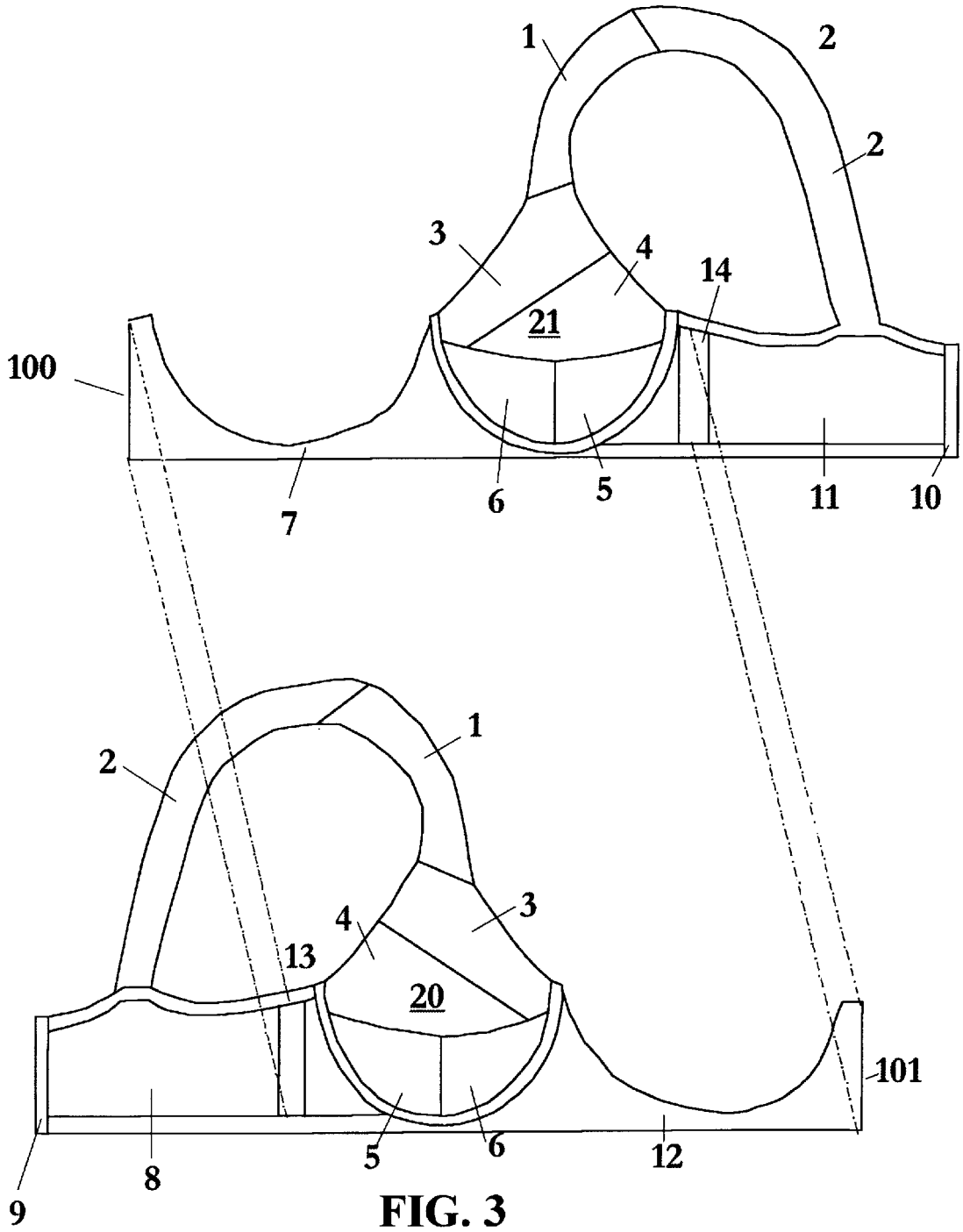
FIG. 3. is a view of the two separate pieces that are used in the construction of the proposed invention.

FIG. 3 illustrates how a cup and its attached wrap section are connected to each other. For example, cup 20 and wrap section 12 are connected and together with a bra strap and a back region 8 and other parts form the component referred to as 30. FIG. 3 shows another component referred to as 31 which includes cup 21, wrap section 7, a bra strap and a back region 11, etc.

The two main components 30 and 31 in FIG. 3 are connected to form the single proposed brassiere at the seams labeled 13 and 14. Seam 13 connects wrap region 7 to region 8. Similarly, seam 14 connects wrap region 12 to region 11. For example, the end of wrap section 7, labeled 100 in FIG. 3, is connected to component 8 at seam 13. 13 is a seam which may include a stay. The location of seam 13 is not in the central-front region of the brassiere but at the side in the region 8. This seam location limitation requirement is necessary to achieve breast separation while wearing the brassiere. Location of the seam along the central-front region of the brassiere does not allow for any measurable separation of breasts during wearing of the brassiere. Similarly, the end of wrap section 12, labeled 101 in FIG. 3, is connected to component 11 at seam 14. 14 is a seam which may include a stay. The location of seam 14 is not in the central-front region of the brassiere but at the side in the region 11.

Figure 2:
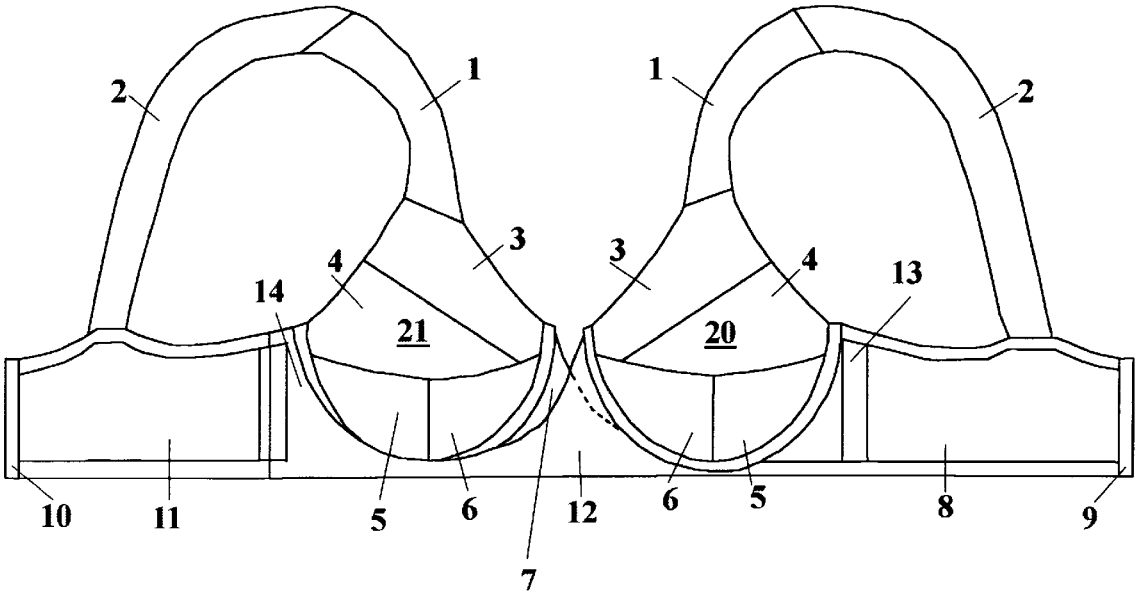
FIG. 2. is a back view of the brassier shown in an open, non-use condition.
Figure 4:
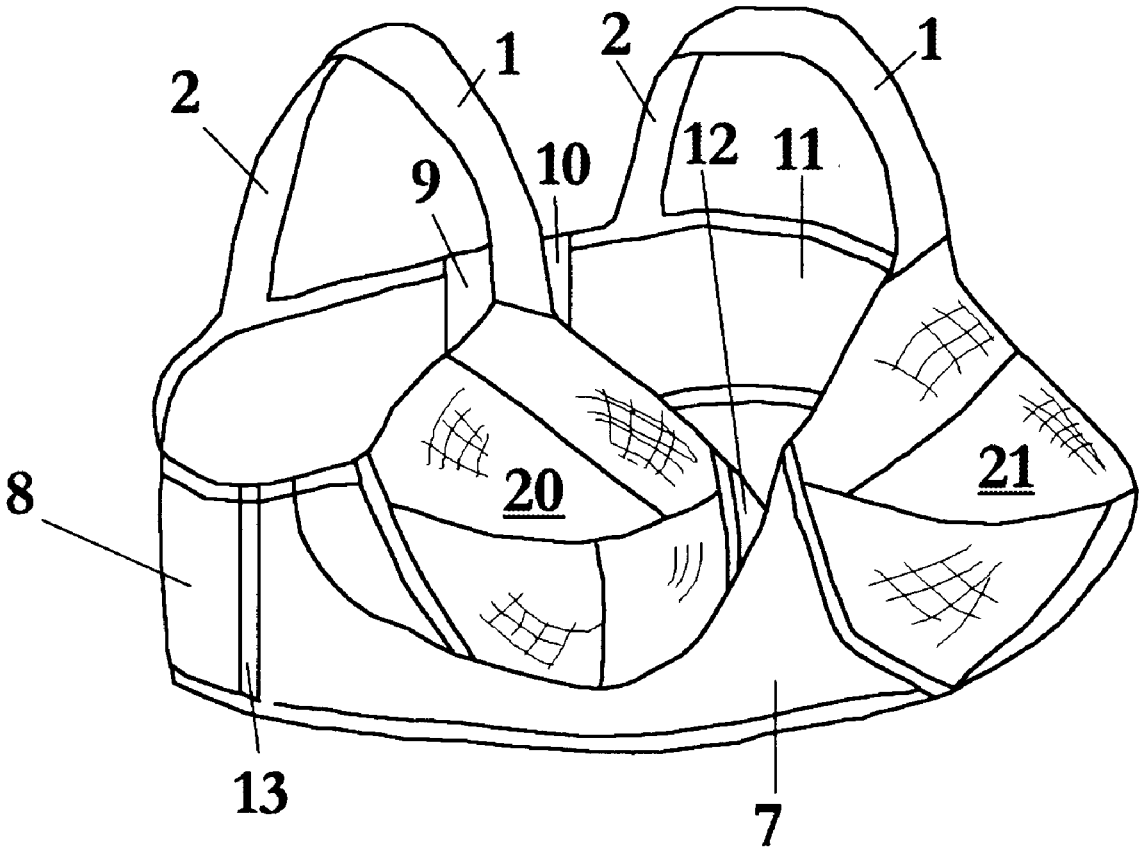
FIG. 4. is a front perspective view of the garment as it would appear in normally worn position of the body of the wearer.

FIG. 1 and FIG. 2 also shows the front and back views of the proposed invention and also illustrates how the two front support structures each including a cup and its wrap secton (e.g. 21 and 7) are connected to the back regions (e.g. 8). These connections are part of the support structure of the brassiere and the wrap sections 7 and 12 wrap and help to support the breasts in addition to other components such as the cups 20 and 21 which also support the breasts. The fact that the front structures (7,21 and 12,20) are not centrally attached in the brassiere gives a form of independence to the breasts which produces a natural separation of the breasts from each other ne ar the breast-bone. Each wrap section (e.g. 7) sits approximately under or across the lower portion of a breast and increases the support of said breast while still allowing a freedom of movement. FIG. 4 a also illustrates the approximate position of a wrap section, 7. Although the embodiment of FIG. 1 and 4 shows the front support structure including 21 and 7 on top of the support structures including 20 and 12, the reverse layering can take place for the invention to operate properly.

Figure 6:
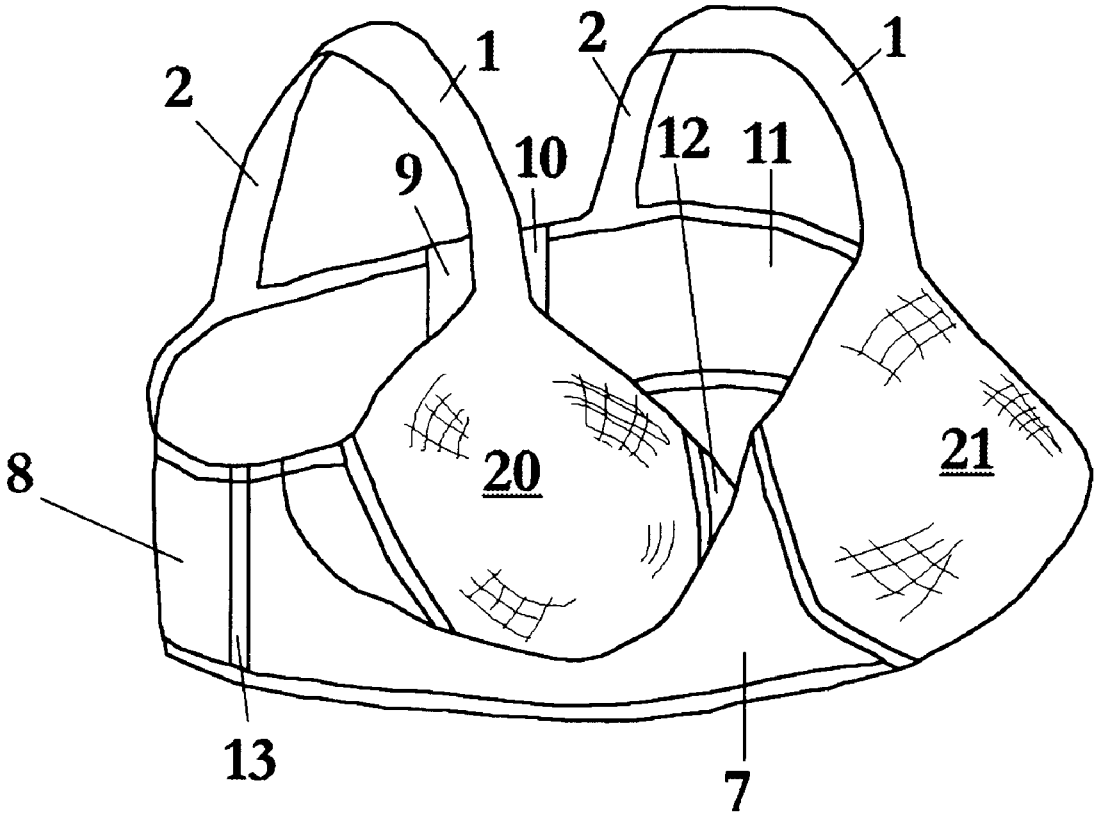
FIG. 6. is a similar view to FIG. 4. showing the invention with a different bra cup construction.

The cups shown in FIG. 1 show the particular embodiment of the brassiere of the present invention also includes overbust seams resulting in each cup region being comprised of components 3,4,5 and 6. The design of the cup alone may take different forms as is shown in FIG. 6. where each cup has no overbust seams. For the invention to operate properly overbust seams are not necessary.

Although in the embodiment of FIG. 1, the cups, 20 and 21, also have underwires for the invention to operate properly underwire components are not necessary.

The back regions of the brassiere, 8 and 11, have fasteners on the end labeled 9 and 10 respectively, that allow the wearer to secure the brassiere in its use condition. Also, the brassiere straps, 1 and 2, are adjustable and may be made of stiff or stretch/elastic materials or some combination of both. For the invention to operate properly, adjustability of the brassiere straps in not necessary.

Although in the embodiment of FIG. 1, the materials used to conrtruct the cups 20, 21, back regions 8, 11 and wraps 7,12 are comprised of a stretch fabric edged with elastic, for the invention to operate properly other kinds of semi-stretch, lace or other materials could be used with or without elastic edging. However stretch fabrics used in the embodiment of FIG. 1 will allow for greater breast separation to better accommodate different women's proportions, increasing the wearer's comfort.

Figure 5:
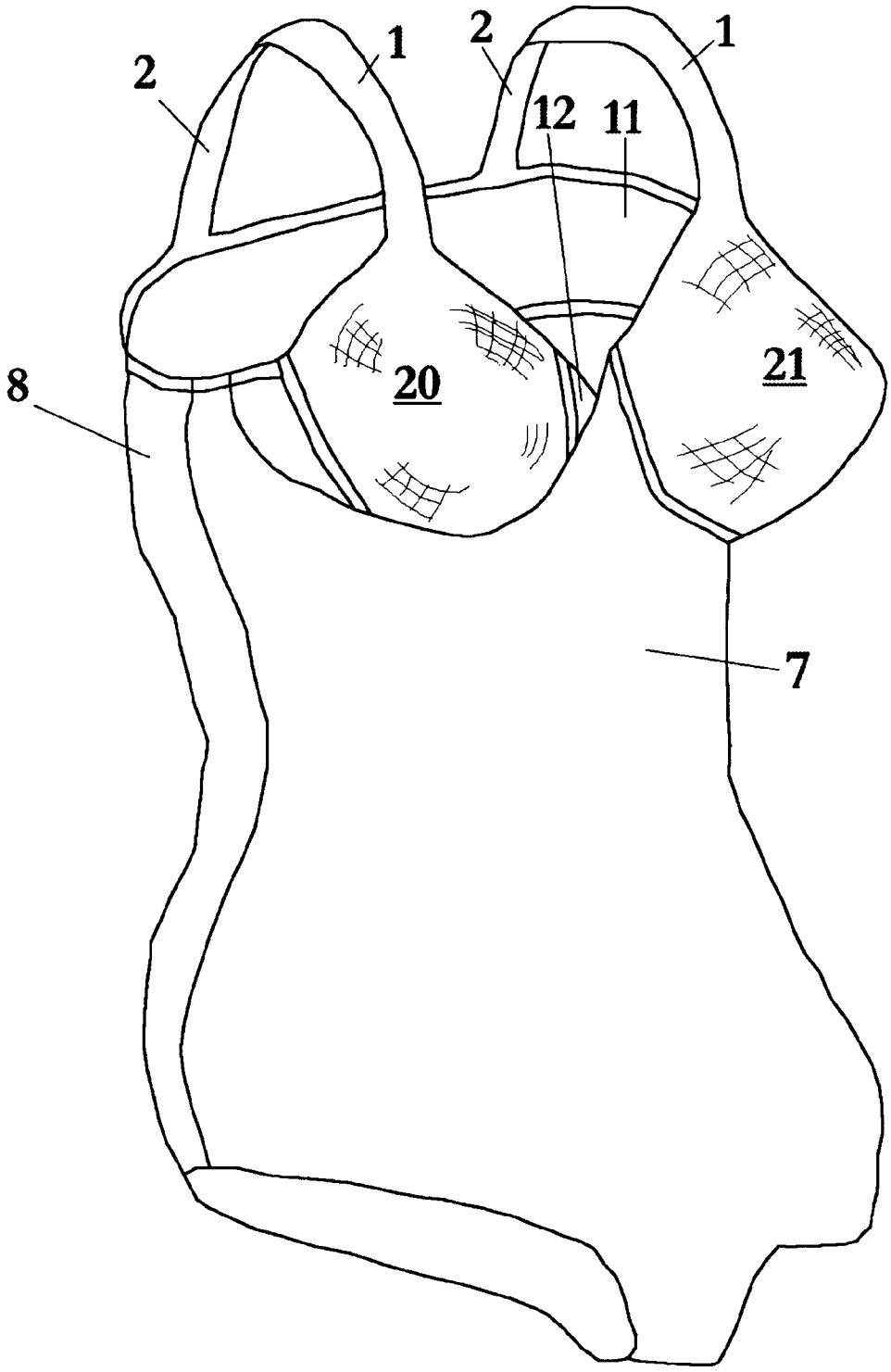
FIG 5. is a perspective view of a body or foundation garment including a brassiere construction with features of the present invention.

Finally, FIG. 5 shows the invention in the form of a body garment or foundation garment. This may be produced as a sports version or fashion apparel that may be produced in different fabrics.

While specific embodiments of the invention have been shown and described in detail to illustrate the application of the principles of the invention, it will be understood that the invention may be embodied otherwise without departing from such principles.

What is claimed is:

1. A brassiere with breast separation feature, comprising:

(a) body encircling means; and (b) a pair of front support structures (e.g of said structure includes 12 and 20) for each breast which wrap one over the other across the chest where one contains one breast and the other contains the other breast; and (c) said front support structures include a cup (e.g. 20) and a wrap section (e.g. 12); and (d) said front support structures provides a means for breast separation and improved breast support, reduction in perspiration and increased comfort; and (e) the end of said front support structures (100 and 101) are connected to the rest of said brassiere at a point corresponding to between the side to the back region of a wearer.

2. The brassier of claim 1, wherein said front support structures, contain:

(a) wrap sections (12 and 7) each of which crosses a lower portion of a bra cup region (20 and 21 respectively); and (b) said wrap sections provide a means for increased breast support while allowing for freedom of movement of supported breast.

* * * * *